US005614031A

United States Patent [19]

Cushing

[11] Patent Number: 5,614,031

[45] Date of Patent: Mar. 25, 1997

[54] METHOD AND APPARATUS FOR WASHING A FIBROUS MAT

[76] Inventor: Ernest W. Cushing, 24854 116th Ave., SE., Kent, Wash. 98031

[21] Appl. No.: 440,325

[22] Filed: May 11, 1995

[51] Int. Cl.[6] ..... B08B 3/02

[52] U.S. Cl. ..... 134/33; 134/42; 134/138; 134/140

[58] Field of Search ..... 134/33, 32, 42, 134/140, 138, 137; 15/302

[56] References Cited

U.S. PATENT DOCUMENTS

| | | | |
|---|---|---|---|
| 4,202,071 | 5/1980 | Scharpf | 15/302 |
| 4,299,245 | 11/1981 | Clapper | 134/140 |
| 4,489,740 | 12/1984 | Rattan et al. | 134/140 |
| 4,521,255 | 6/1985 | Raymor et al. | 134/33 |
| 4,545,395 | 10/1985 | Kolb | 134/140 |
| 4,889,564 | 12/1989 | Kikuchi et al. | 134/140 X |
| 5,238,012 | 8/1993 | Coronato | 134/140 |

*Primary Examiner*—Jill Warden
*Assistant Examiner*—Saeed Chaudhry
*Attorney, Agent, or Firm*—Keith A. Cushing

[57] ABSTRACT

Washing of a fibrous mat as disclosed herein, including both rinsing and drying steps and apparatus, occurs within an enclosure receiving a source of aqueous solution and mounting the fibrous mat rotationally therein. While water jet streams produce a first rotational force, a second rotational force, such as by hand crank or electric motor, of greater magnitude moves the mat in a direction opposite that of the water jet streams to produce significant relative velocity between the mat and the water jet streams. Following rinsing, a drying step includes rotating the mat to drive water therefrom.

8 Claims, 3 Drawing Sheets

13
14
17
15
10
19
12
16
182
164
162
180
62
170
160
190
150
18
64
52
140
40
54
16a
60
152
192
32

METHOD AND APPARATUS FOR WASHING A FIBROUS MAT

BACKGROUND OF THE INVENTION

The present invention relates generally to cleaning apparatus, and particularly a method and apparatus for rinsing and drying of a fibrous floor cleaning and finishing mat.

In many floor cleaning and finishing operations a fibrous mat mounts upon a rotating motorized device to clean or finish a floor surface. The fibrous mat collects dirt and cleaning or waxing material from the floor. In some uses the fibrous mat removes a thin layer of the floor to expose fresh tile for buffing and waxing. The fibrous mat also cleans the tile or floor with a cleaning solution prior to waxing and buffing the floor. A variety of fibrous mats are used for a variety of purposes. In any case, the fibrous mat becomes impregnated with particles removed from the floor and must be cleaned or replaced to continue or repeat the cleaning or finishing operation. To make best possible use of such fibrous mats, the mat should be clean when used. Once the mat becomes impregnated with foreign particles, it is replaced or, as provided under the present invention, cleaned and re-used.

The cost of cleaning a fibrous mat as compared to the cost of replacing a fibrous mat can justify investment in a cleaning or rinsing apparatus for the mat. The present invention provides a rinsing apparatus at a cost recoverable in reduced purchase of new fibrous mats. Furthermore, fibrous mats used in floor cleaning and finishing operations present environmental concerns when deposited in landfills. Accordingly, use of a fibrous mat for as many times as possible before disposing promotes environmental concerns.

U.S. Pat. No. 4,521,255 filed Jul. 25, 1983 by Raymor et. al., issued Jan. 4, 1985 and entitled METHOD FOR WASHING A FIBROUS MAT shows a fibrous mat cleaned by directing an aqueous medium into contact with two opposed surfaces of the mat while the mat is positioned on a rotatable support within a container. The impact of aqueous medium, e.g., water, on the rotatably mounted fibrous mat urges the mat into rotation in a corresponding direction and speed, i.e., in a direction corresponding to the direction of water impacting the mat. As the mat begins rotation and reaches sufficient speed, centrifugal force drives particles within the mat outward. Raymor et. al. show a container with a water input hose coupled to nozzles within the container and a discharge outlet allowing flow of water from the container. A rotatable mounting for the fibrous mat positions the mat adjacent the nozzles. Nozzle output, i.e., jet streams hitting the mat, cause rotation of the fibrous mat within the container.

SUMMARY OF THE INVENTION

A method of cleaning a fibrous mat in accordance with a preferred embodiment of the present invention includes mounting rotatably the mat within an enclosure, directing aqueous solution into the mat whereby the aqueous solution applies a first force to the mat, and rotating the mat by application of a second force to the mat. In accordance with one aspect of the present invention, the aqueous solution, by virtue of oblique orientation relative to the mat, applies a rotational force to the mat in a first rotational direction opposite that applied by the second force. In this manner, the relative speed is maximized between the aqueous solution approaching the mat and the mat. In accordance with a further aspect of the present invention, the method also includes a drying step wherein the step of directing aqueous solution into the mat is terminated, while the step of rotating the mat continues whereby aqueous solution leaves the mat.

The present invention provides an apparatus for cleaning a fibrous mat including a container having an inlet for receiving a source of aqueous solution and an outlet for draining aqueous solution. A hub within the container receives the mat and allows rotation of the mat therein. A nozzle array coupled to the inlet directs aqueous solution into the mat, and thereby applies a first force to the mat. A rotational drive coupled to the hub rotates the mat by application of a second force to the mat. In accordance with one aspect of the present invention, the nozzle array directs aqueous solution at an oblique angle relative to the mat to produce in conjunction with the hub a first rotational force on the mat in a first rotational direction. The rotational drive, applying a second force to the mat, moves the mat in a rotational direction opposite that of the first rotational force. In this manner, the relative speed between the aqueous solution and the rotating mat is maximized, thereby maximizing the force of impact and cleaning effect provided thereby.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
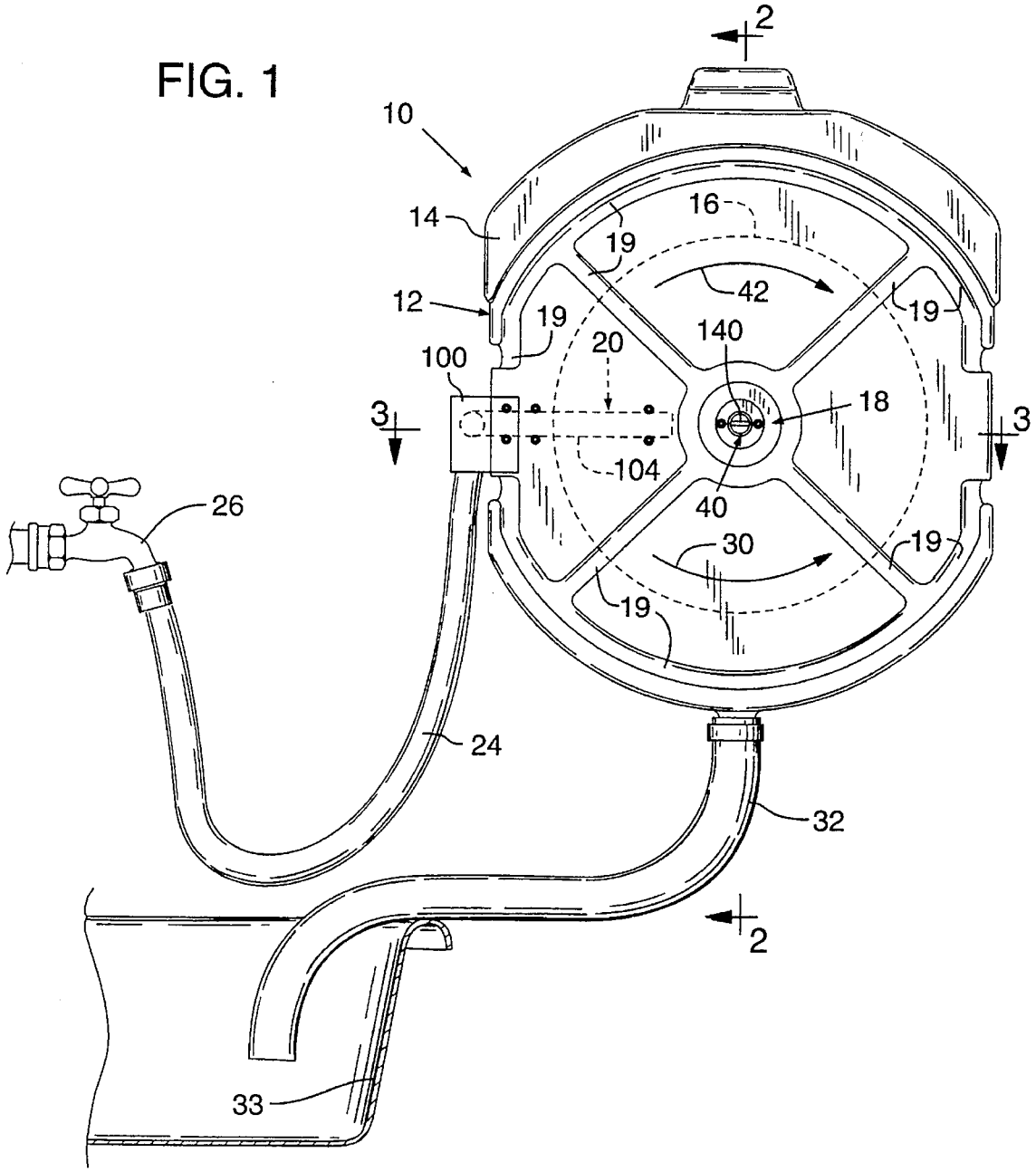
FIG. 1 illustrates a face view of a rinser in accordance with a preferred embodiment of the present invention as coupled to a water source and a water drain.

The preferred embodiment of the invention as illustrated in the drawings comprises generally a rinsing and drying device for fibrous mats used in floor cleaning and finishing operations. The rinser of the present invention mounts in a janitorial work room adjacent a water source and sink whereby a fibrous mat conveniently mounts therein for rapid rinsing, drying and repeated use. Generally, a fibrous mat is first soaked if necessary, then placed in the rinsing and drying apparatus of the present invention. In a first phase, the mat undergoes rotation and exposure to water jet streams to rinse particles from the mat. In a second phase, the mat is rotated to expel water and thereby dry the mat.

Figures 2, 5A, 5B:
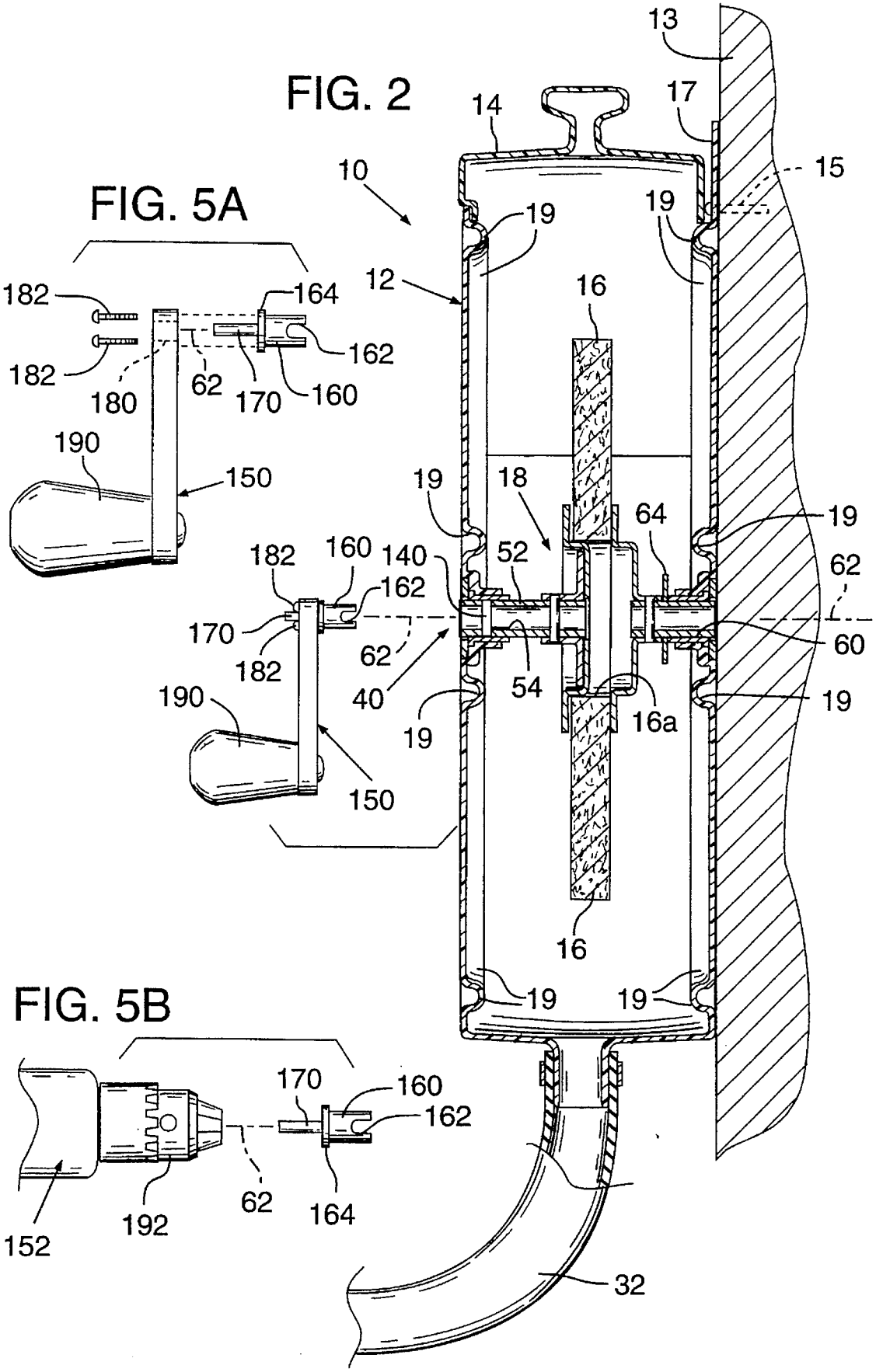
FIG. 2 is a sectional edge view of the rinser of FIG. 1 as taken along lines 2—2 of FIG. 1.
FIGS. 5A and 5B illustrate alternate drives applying rotational force to a fibrous mat within the rinser of FIG. 1.

With reference to the accompanying drawings, rinser 10 is a generally disk-shaped container 12 and lid 14. Container 12 and lid 14 are formed, in the preferred embodiment, by roto-moulding process. While a variety of materials may be used in constructing container 12 and lid 14, an acceptable material for this purpose is high density polyethylene EXON (TM) No. 8761. With reference in particular to FIG. 2, rinser 10 mounts to a wall 13 by inserting mounting screws 15 through an upstanding panel 17 of container 12. As may be appreciated, such mounting of rinser 10 my be permanent, or dismountable if desired.

Structural ribs 19 integral to container 12 allow container 12 to resist collapsing forces. Structural ribs 19 are located about the periphery of sidewalls 12*a* and 12*b*, and also extend radially inward toward hub 18. As viewed exteriorally, structural ribs 19 appear as groove-shaped features. In cross section, however, structural ribs 19 appear as semi circular deviations in the otherwise planar structure of sidewalls 12*a* and 12*b*.

A fibrous mat 16 within container 12, i.e., positioned therein by removing lid 14, mounts rotatably upon a hub 18. As mounted on hub 18, mat 12 is freely rotatable in either direction. A nozzle array 20, including a plurality of individual nozzles 21 located adjacent each surface of mat 16, directs water jet streams 22 angularly into each surface of mat 16. An inlet hose 24 fluidly couples to a water source, e.g., faucet, 26. Upon opening faucet 26, water enters container 12 via inlet hose 24 and exits nozzle array 20 as jet streams 22. Jet streams 22, as viewed in FIG. 1, are directed generally angularly downward and produce, in conjunction with the rotatable mounting of mat 16, a counter-clockwise rotational force 30 (FIG. 1). Water discharged from nozzle array 20, after striking mat 16, eventually reaches the lower portion of container 12 and exits container 12 via drain outlet 32. Drain outlet 32 discharges into, for example, a sink or basin 33.

A drive coupling 40 integral to hub 18 allows selected rotation of mat 16. In the preferred embodiment of the present invention, drive coupling 40 introduces a clockwise, in the view of FIG. 1, rotational force 42 overcoming the counter-clockwise rotational force 30 originating from impact of jet streams 22 on mat 16. Mat 16 thereby undergoes clockwise, in the view of FIG. 1, rotation when rinsing under the preferred form of the present invention. Mat 16 moves in a direction opposite that of jet streams 22. Such rotation in relation to the orientation of nozzle array 20 produces significant relative velocity between mat 16 and jet streams 22, even when faucet 26 provides relatively weak water pressure.

Figure 3B:
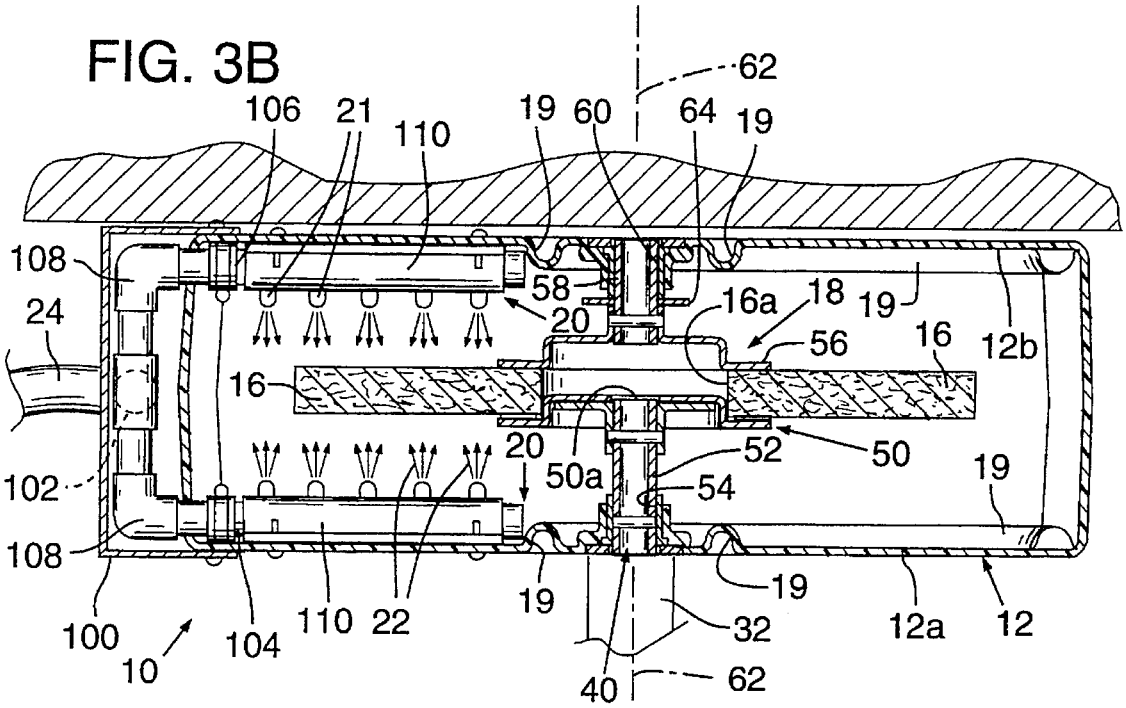
FIGS. 3A and 3B are sectional top views of the rinser of FIG. 1 as taken along lines 3—3 of FIG. 1.
Figure 3A:
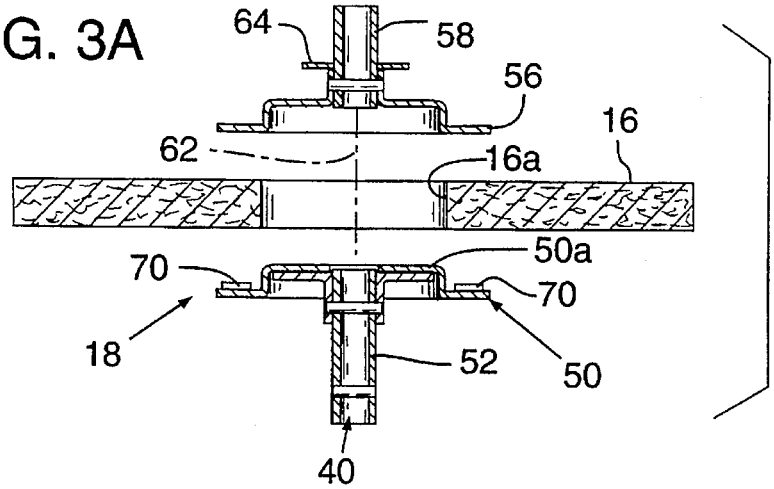

With reference in particular to FIGS. 2, 3A, and 3B, hub 18 includes a front plate 50 carried by an axle 52. Axle 52 rotatably mounts within a bushing 54 carried by sidewall 12*a* of container 12. Hub 18 further includes a back plate 56 carried by an axle 58 rotatably mounted within a bushing 60 of sidewall 12*b* of container 12. Axles 52 and 58 are coaxial along an axis of rotation 62. Bushings 54 and 60 may be constructed generally of a plastic sleeve provided by a variety of materials. Each of axles 52 and 58 are pipe or tube-shaped as provided by stainless steel tubing. In the preferred form of the present invention, exterior surfaces of axles 52 and 60 are finished for compatibility with bushings 54 and 60, e.g., a No. 4 grain finish.

Front plate 50 carries centrally an upraised circular support 50*a* fitting closely within the central circular opening 16*a* of mat 16. In this manner, mat 16 assumes a well centered position relative to axis of rotation 62. Further, residing peripherally outward from structure 50*a*, front plate 50 further includes gripping elements 70, e.g., in the preferred embodiment of the present invention the hook structures of a VELCRO (TM) brand material. Gripping elements 70 engage mat 16 and maintain mat 16 rotationally stationary relative to front plate 50.

Front plate 50 and back plate 56 are axially slidable within the corresponding bushings 54 and 60, respectively. Axial movement of front plate 50 and back plate 56 facilitates both removal of front plate 50 and back plate 56 as well as mounting of mat 16 within container 12. In particular, to mount mat 16 within container 12 and upon hub 18, one urges back plate 56 fully toward sidewall 12*b*. Mat 16 is then positioned generally between front plate 50 and back plate 56 by moving front plate 50 toward sidewall 12*a*. Once mat 16 is so positioned, front plate 50 moves toward mat 16 to position structure 50*a* within opening 16*a* of mat 16. Mat 16 is thereby captured for rotational movement about the axis 62.

Intermediate back plate 56 and sidewall 12*b*, a stainless steel washer 64 protects sidewall 12*b* against the excess frictional heat otherwise developed if back plate 56 were allowed direct contact with sidewall 12*b* during rotation of back plate 56. More particularly, back plate 56 bears against washer 64, mat 16 bears against back plate 56 and front plate 50 bears against mat 16. By maintaining slight pressure against drive coupling 40 toward sidewall 12*b*, mat 16 remains mounted upon hub 18 during rotation thereof.

Figure 4:
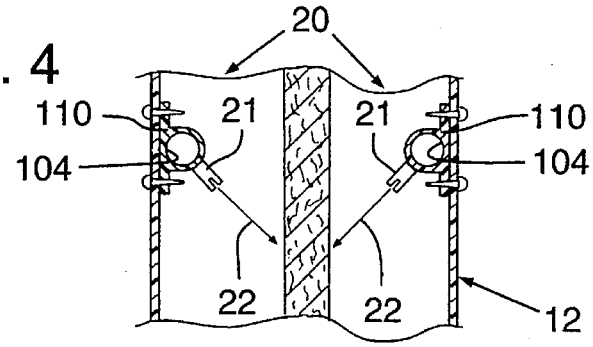
FIG. 4 is a sectional partial end view of the rinser of FIG. 1 illustrating relative orientation between water nozzles and a fibrous mat in the rinser of FIG. 1.

Inlet 24 enters a shroud 100 mounted upon the container 12. Shroud 100 provides a safety enclosure and aids in rigidity. Within shroud 100, a T-joint 102 receives inlet 24 and divides the flow of water entering container 12. More particularly, conduits 104 and 106, each including an elbow 108, extend into container 12 from T-joint 102. Mounting brackets 110 each hold one of conduits 104 and 106. Water nozzles 21 extend from conduits 104 and 106. More particularly, each of conduits 104 and 106 carry, in the preferred embodiment of the present invention, five nozzles 21. Each nozzle 21 is directed toward the location of a mat 16 as mounted upon hub 18, but as noted above, angular orientation produces counter-clockwise rotational force 30 upon mat 16. While nozzles 21 may be oriented in a variety of arrangements, in the preferred embodiment of the present invention, each nozzle resides generally at a 45 degree angle relative to the mat 16 as mounted upon hub 18 (see FIG. 4). Also, a variety of nozzles 21 may be employed, but in the preferred embodiment of the present invention nozzles 21 are plastic and available from Bete Fog Nozzle, Inc. under product number PF0580.

Conduits 104 and 106 are generally in parallel relation and on directly opposite sides of a mat 16 as mounted on hub 18. Alternative forms of the present invention include, however, mounting of conduits 104 and 108 at offset positions, so as to not cooperate in driving particles to the center of a mat 16. Experimentation shows, however, that the illustrated parallel and radially concurrent mounting of conduits 104 and 108 cleans mats 16 exceptionally well.

Drive coupling 40 comprises, in the preferred embodiment of the present invention, a post 140 within the interior of tube-shaped axle 52 and lying transverse to the axis of rotation 62. A variety of devices may be used to engage drive coupling 40. In one embodiment of the present invention, a handle 150 (FIGS. 2 and 5A) provides manual rotation of a mat 16. In a second embodiment, a bi-directional variable speed hand held electric motor 152 (FIG. 5B), e.g., a hand drill, causes rotation of a mat 16. A cylindrical socket 160 includes a transverse slot 162 and fits closely within the interior bore of axle 52. Socket 160 extends into axle 52 sufficient distance to allow placement of post 140 within slot 162. Socket 160 includes a relatively greater diameter shoulder 164. Shoulder 164 bears against axle 52 when placing socket 160 within axle 52. Socket 160 further includes a post 170 extending outward from axle 152 when socket 160 is mounted therein.

In FIGS. 2 and 5A, handle 150 mounts upon socket 160 by inserting shaft 170 through aperture 180 of handle 150. Mounting screws 182 extend through handle 150 and engage threaded bores (not shown) of socket 160. Handle 150 includes, at its opposite end, a knob 190 rotatably mounted upon handle 150. An operator grasps knob 190 and rotates socket 160, thereby rotating drive coupling 40 and a mat 16 as mounted upon hub 18.

In the alternative, hand-held electric motor 152 (FIG. 5B) rotates socket 160. More particularly, a chuck 192 of motor 152 receives shaft 170 of socket 160 and drives socket 160 into rotation. Preferably, motor 152 allows selected rotational speed and direction for a mat 16 when mounted upon hub 18 and driven by motor 152.

In overall operation, a user of rinser 10 first removes lid 14, places a mat 16 on hub 18, and replaces lid 14. Faucet 26 is then opened fully to produce water jets 22. Mat 16 is then driven into rotation opposite that of jet streams 22. The operator may induce such rotation by means of handle 150 or electric motor 152. Rotation continues for a brief interval, e.g., 10 seconds. The operator turns off faucet 26. The operator again rotates mat 16, e.g., by way of handle 150 or motor 152, to drive excess water from mat 16. The entire operation takes less than one minute, typically on the order of 30 seconds, including cleaning and drying of the mat 16.

Prior fibrous mat cleaning devices, while serving as an advance in their time, inherently lack certain features provided by rinser 10 operating under the present invention. First, the mat 16 is driven into rotation by an external power source, e.g., handle 150 or motor 152. The direction of water into the mat is opposite that of prior rinsing apparatus. In other words, water direction is opposite that of mat 16 movement. Prior mat rinsing devices, e.g., such as in U.S. Pat. No. 4,521,255 cited herein above, suffer when insufficient water pressure is available to drive the fibrous mat at sufficiently high rotational speeds. Eventually, water speed and direction closely matches that of mat speed and direction and diminishes any rinsing effect caused by the impact of water on the mat. Under the present invention, however, even under low water pressure conditions significant relative velocity between water jets 22 and mat 16 results in thorough rinsing. Furthermore, because rinser 10 rotates mat 16 independently of water jet 22 impact, rinser 10 serves the additional function of drying a mat 16 by simply rotating mat 16 following rinsing by water jets 22. Prior mat rinsing apparatus lacked independent means for rotation of the mat, and thereby lacked an ability to dry the mat. Under the rinser 10 of the present invention, mats 16 may be dried to approximately 90 percent by rotating handle 150 or actuating motor 152.

It will be appreciated that the present invention is not restricted to the particular embodiment that has been described and illustrated, and that variations may be made therein without departing from the scope of the invention as found in the appended claims and equivalents thereof.

What is claimed is:

1. A method of cleaning a fibrous mat, the method comprising the steps:

mounting rotatably the mat within an enclosure;

directing aqueous solution into said mat, said aqueous solution applying a first rotational force to said mat urging said mat toward a first rotational direction; and rotating said mat in a second rotational direction by application of a second rotational force to said mat, said second rotational force being opposite and of greater magnitude relative to said first rotational force.

2. A method according to claim 1 wherein said directing step comprises directing said solution at oblique orientation relative to said mat and by virtue of said mounting step said first rotational force is in said first rotational direction.

3. A method according to claim 1 wherein said rotating step includes a rinsing step concurrent with said directing step and a drying step following termination of said directing step.

4. A method according to claim 1 wherein said aqueous solution is water.

5. A method according to claim 1 further comprising a step of draining said aqueous solution from said container.

6. A method according to claim 1 wherein said directing step comprises directing said aqueous solution into opposing surfaces of said mat.

7. A cleaning apparatus for a fibrous mat, the apparatus comprising:

a container including an inlet for receiving a source of aqueous solution and an outlet for releasing aqueous solution from said container;

a hub receiving said mat, said hub allowing rotation of said mat;

a nozzle array coupled to said inlet and directing aqueous solution into said mat and thereby applying a first rotational force to said mat in a first rotational direction; and a rotational drive coupled to said hub, said drive rotating said mat in a second rotational direction by application of a second rotational force to said mat, said second rotational force being opposite and of greater magnitude relative to said first rotational force.

8. An apparatus according to claim 7 wherein said nozzle array directs said aqueous solution at oblique angle relative to said mat to produce in conjunction with said hub said first rotational force on said mat in said first rotational direction.

* * * * *